US012559203B2

(12) United States Patent
Raiola

(10) Patent No.: US 12,559,203 B2
(45) Date of Patent: Feb. 24, 2026

(54) PLEASURE CRAFT HAVING AN IMPROVED DECK CONSTRUCTION

(71) Applicant: ARCHIMEDE MARINE INNOVATIONS & SOLUTIONS S.R.L.—IN BREVE—AMIS SRL, Rome (IT)

(72) Inventor: Giancarlo Raiola, Ameglia (IT)

(73) Assignee: Archimede Marine Innovations & Solutions S.r.l.—in breve—AMIS S.r.l., Rome (IT)

( * ) Notice: Subject to any disclaimer, the term of this patent is extended or adjusted under 35 U.S.C. 154(b) by 583 days.

(21) Appl. No.: 17/922,451

(22) PCT Filed: May 5, 2021

(86) PCT No.: PCT/IB2021/053783

§ 371 (c)(1),
(2) Date: Oct. 31, 2022

(87) PCT Pub. No.: WO2021/224814

PCT Pub. Date: Nov. 11, 2021

(65) Prior Publication Data

US 2023/0174195 A1 Jun. 8, 2023

(30) Foreign Application Priority Data

May 5, 2020 (IT) ..... 102020000009886

(51) Int. Cl.
*B63B 3/48* (2006.01)

(52) U.S. Cl.
CPC ..... *B63B 3/48* (2013.01)

(58) Field of Classification Search
CPC .. B63B 3/00; B63B 3/48; B63B 11/00; B63B 11/02; B63B 29/02
See application file for complete search history.

(56) References Cited

U.S. PATENT DOCUMENTS 865,155 A * 9/1907 Barwis ..... B63B 29/02 114/71
1,066,087 A * 7/1913 Dingwall ..... B63B 3/00 114/69

(Continued)

FOREIGN PATENT DOCUMENTS

GB 114511 A * 4/1918
GB 2213436 A * 8/1989 ..... B63B 35/308

(Continued)

OTHER PUBLICATIONS

International Search Report and Written Opinion of the International Searching Authority issued for International PCT Application No. PCT/IB2021/53783 on Sep. 3, 2021.

*Primary Examiner* — Joseph W Sanderson
(74) *Attorney, Agent, or Firm* — Howson & Howson LLP

(57) ABSTRACT

A pleasure craft is provided such as a luxury pleasure craft. The craft eliminates the need for transverse bulkheads in one or more decks inside the hull of the craft, thus improving the aesthetics and usability thereof. The hull of the pleasure craft defines an imaginary or virtual freeboard deck located below the main deck of the craft. A cavity is arranged on one or more decks on both sides of the hull separate from the remaining space of the corresponding deck and delimited on its outer side by the corresponding side wall. The imaginary or virtual freeboard deck is therefore at a height equal to the extension in the vertical direction of the cavities from the floor of the corresponding deck.

16 Claims, 2 Drawing Sheets

(56) References Cited

U.S. PATENT DOCUMENTS

| | | | | | |
|---|---|---|---|---|---|
| 1,911,625 | A * | 5/1933 | Lambert | B63B 3/26 | 114/78 |
| 2,721,341 | A * | 10/1955 | Roberts | B63B 5/24 | 114/65 R |
| 4,292,915 | A * | 10/1981 | Nemec | B63B 3/48 | 114/260 |
| 5,901,656 | A * | 5/1999 | Cheung | B63B 11/04 | 114/125 |
| 6,694,908 | B2 * | 2/2004 | Parsons | B63B 13/00 | 114/74 R |
| 8,752,499 | B2 * | 6/2014 | De Basto | B63B 17/04 | 114/364 |
| 9,193,417 | B2 * | 11/2015 | de Basto | B63B 3/48 | |
| 9,278,732 | B2 * | 3/2016 | Yamato | B63B 43/06 | |
| 10,526,052 | B2 * | 1/2020 | Oh | B63B 3/26 | |
| 10,526,053 | B2 | 1/2020 | Inzadi | | |
| 2003/0019413 | A1 * | 1/2003 | Parsons | B63B 13/00 | 114/74 R |
| 2013/0239871 | A1 | 9/2013 | Basto et al. | | |
| 2014/0202372 | A1 | 7/2014 | de Basto et al. | | |
| 2018/0304976 | A1 * | 10/2018 | Oh | B63B 3/16 | |

FOREIGN PATENT DOCUMENTS

| | | | | |
|---|---|---|---|---|
| GB | 2536920 | A * | 10/2016 | B63B 11/02 |
| KR | 2012-0119333 | A | 10/2012 | |
| KR | 20170141528 | A * | 12/2017 | |
| KR | 20120067425 | A * | 1/2018 | |
| WO | 2010/114369 | A2 | 10/2010 | |

* cited by examiner

PLEASURE CRAFT HAVING AN IMPROVED DECK CONSTRUCTION

TECHNICAL FIELD

The present invention relates to a pleasure craft comprising a hull, the inner space of which is divided into a plurality of overlying decks.

More particularly, the present invention relates to a pleasure craft in which one or more decks have an improved construction, allowing improving the usability of spaces.

The invention advantageously finds application especially in the field of luxury pleasure crafts such as yachts.

BACKGROUND ART

Pleasure crafts are known comprising a hull and a main deck, on which a superstructure capable of housing, for example, a passenger cabin and/or the helm station for the craft owner, is provided.

Inside the hull, the space is divided into one or more overlying decks, which accommodate further spaces for passengers' use (in addition to those provided on the main deck), as well as the engine room, the compartments for the crew, the rooms for the storage and conservation of materials, and so on.

For example, luxury pleasure crafts having a length of over 35 meters (and in particular between 35 meters and 70 meters) comprise, besides and below the main deck, a middle deck (usually referred to as "lower deck" in the technical field of reference) and a lowermost deck (usually referred to as "underlower deck" in the technical field of reference).

Both the lower deck and the underlower deck are provided inside the hull and below the main deck: the lower deck is located immediately below the main deck; the underlower deck is located below the lower deck, immediately above the keel of the hull and houses the engine room as well as storage rooms and the like.

Generally, the lower deck houses a first area located in the proximity of the bow and intended for the crew, i.e. the personnel necessary for the proper conduct of the craft, a second, central area intended for the passengers of the craft, and a third area located at the stern and housing the garages for tenders, jet skis and the like.

In addition, in the pleasure crafts of known type, the engine room usually extends beyond the underlower deck and up to the main deck, thus partially occupying also the lower deck, in which a fourth area is thus defined, communicating with the underlying underlower deck and occupied by the propulsion systems and the equipment necessary for the operation thereof.

Generally, by "freeboard" of a craft it is meant the vertical distance between a horizontal line drawn at the intersection of the flanks with the planking of the uppermost complete deck with permanent closures (called "freeboard deck") and the waterline corresponding to the maximum load that the craft is authorized to take on board, depending on the specific characteristics of the travel that the craft is about to undertake.

Therefore, the freeboard of a craft is not a constant quantity, but it varies according to the conditions under which the craft travels (fresh or salt water, calm or rough seas, summer or winter season, etc.).

For this reason, freeboard marks are assigned to each craft, said freeboard marks indicating the maximum height that the waterline can reach depending on the navigating travels to be undertaken.

The reasons requiring a freeboard to be assigned are strictly related to the safety of the craft and aim to ensure that the craft has a good reserve of thrust and a good reserve of buoyancy.

In order to determine the freeboard, it is first necessary to establish what the freeboard deck is, i.e. the deck that is to be taken as the reference for measuring the vertical distance between said deck and a particular waterline.

In pleasure crafts of the type described above, the freeboard deck coincides with the main deck.

For safety reasons, a buoyancy division is imposed on passenger vessels (including, of course, pleasure crafts), whereby the volume below the main deck and within the hull is divided into a plurality of compartments of sufficient capacity to ensure that the vessel has a sufficient reserve of thrust even when one of these compartments (or some of them) is (are) in free communication with the surrounding water due to a hull breach.

For this reason, in vessels of the type described above, there are arranged transverse bulkheads dividing the craft hull into longitudinal watertight compartments.

Therefore, said bulkheads extend from the lowermost deck until below the main deck (freeboard deck).

Referring to the example of the luxury pleasure craft described above, the bulkheads thus extend from the floor of the underlower deck, extend in height through the entire underlower deck and the overlying lower deck and terminate immediately below the main deck (freeboard deck).

Accordingly, the hull is divided along the longitudinal direction into watertight compartments, which are spaces necessary to create a reserve of stability for the craft in case of damage to the hull: their longitudinal extension (and therefore their number) is determined on the basis of current regulations and are designed so that the craft can survive in the event of a hull breach, limiting the spread of flooding inside the hull.

The provision of transverse bulkheads is generally not a problem for the deck or decks intended to house the engine room and the storage rooms.

Referring to the example of the luxury pleasure craft described above, the provision of transverse bulkheads does not therefore constitute a significant problem in the underlower deck.

Said transverse bulkheads are, instead, a clear disadvantage in those decks housing spaces for passengers' use.

Referring to the example of the luxury pleasure craft described above, the provision of said transverse bulkheads is undesired in the lower deck, especially as far as the area of this deck intended for the passengers is concerned.

First of all, they represent a constraint to the arrangement of spaces: in the design of passengers' areas and in the choice of their purpose, it is necessary to take into account the presence of such transverse bulkheads and their possible implementation in case of a hull breach.

Secondly, they are aesthetically unappealing and consequently undesirable, especially in the case of luxury vessels.

The main object of the present invention is therefore to provide a pleasure craft in which, while complying with current safety regulations, it is possible to eliminate the need for transverse bulkheads in one or more decks inside the hull of the craft.

This and other objects are achieved with a pleasure craft as claimed in the appended claims.

SUMMARY OF INVENTION

As mentioned above, in known pleasure crafts of the type described above, the freeboard deck coincides with the main deck.

Accordingly, the buoyancy division will affect all the decks below the main deck.

According to the invention, it is provided to design one or more decks of the pleasure crafts in such a way that an imaginary or virtual freeboard deck is defined, located below the main deck.

In this way, the buoyancy division needs to affect only the decks below said imaginary or virtual freeboard deck.

For example, in the particular instance of a luxury pleasure craft of the type comprising a lower deck and an underlower deck inside the hull, it will be possible to provide a pleasure craft in which the transverse bulkheads are required only in the underlower deck, while they can be omitted in the lower deck.

It will thus be possible to eliminate a penalizing constraint in determining the arrangement of spaces in the lower deck.

In particular, should the present invention be applied in conjunction with the teachings of Italian patent application No. 102020000007294 in the name of the same Applicant, according to which the whole engine room and the technical room associated therewith are housed in the underlower deck only, the design and use of the spaces of the lower deck would be greatly improved.

In order to design the aforementioned imaginary or virtual freeboard deck, the invention provides to arrange, on both sides of one or more decks housed in a hull and integral thereto, a separate compartment having a given height and width and delimited on its outer side by the external wall of the hull.

In order to attain this result, for each side of the hull, at a given distance from the side wall of the hull there is provided an additional framing extending vertically over a given height, which additional framing will then join with the framing of the side wall of the hull.

For the deck, or for each of the decks, for which this measure is implemented, cavities will thus be provided along each side of the hull, said cavities having a given height and width and being separate from the remaining space of the corresponding deck.

In this regard, it should be noted that document U.S. Pat. No. 865,155 discloses a solution in which cavities are provided between the side walls of the hull and the space inside the hull.

However, the solution disclosed in U.S. Pat. No. 865,155 has nothing to do with the present invention.

Indeed, document U.S. Pat. No. 865,155 relates to a cabin or a deck independent of the rest of the hull, which cabin or deck is retained within the hull solely by the force of gravity and can be separated from the hull and float in case the vessel should sink because of a hull breach.

The present invention, instead, relates to the construction of the vessel itself rather than to the construction of a unit separate therefrom.

Nor is it conceivable that the person skilled in the art would have found in U.S. Pat. No. 865,155 any hint or direction to arrive at the present invention.

As mentioned above, the object of the present invention is to define an imaginary or virtual freeboard deck, located below the main deck so as to avoid the need to provide buoyancy division in one or more decks below the main deck. In other words, the object of the present invention is to provide, below the main deck, one deck as a single space or several decks as single spaces, without transverse bulkheads.

On the contrary, the teaching of U.S. Pat. No. 865,155 goes in the direction of a total division of the spaces of the vessel, which are made as independent, autonomous units that can be separated from one another as well as from the hull of the vessel.

According to the present invention, said cavities can be watertight or, preferably, communicating with the underlying deck(s) for the disposal of floodwater that may enter the vessel in case of a hull breach.

Said cavities may be divided along the longitudinal direction into separate compartments.

The height over which said lateral cavities extend from the deck floor will define the plane of an imaginary or virtual freeboard deck.

Thanks to the fact that the space inside said cavities is separate from the remaining space of the deck, it will be possible to avoid the need to provide transverse bulkheads inside the deck.

Transverse bulkheads will thus have to be provided solely in the underlying deck(s).

The width and height of the lateral cavities are chosen each time according to the specific requirements of each vessel.

In any case, it will not be necessary to provide that said bulkheads extend over the entire height of the corresponding deck; they can, instead, in any case have a height that is less than the height of the corresponding deck.

Therefore, unlike what is disclosed in U.S. Pat. No. 865,155, the present invention relates to a modification in the construction of the vessel itself and of the hull thereof, rather than to a part that is separate or can be separated therefrom.

This results in that no excessive volume of the corresponding deck is sacrificed for making said cavities.

This is an undoubted advantage in the case of luxury pleasure crafts, in which a strong need is felt to maximize the spaces for passengers' use.

Advantageously, eliminating the transverse bulkheads from one or more decks makes it possible to obtain a vessel more capable of adapting to any requirement of arrangement of spaces and furniture.

In addition, eliminating said transverse bulkheads from one or more decks allows for cost and time reduction in the manufacturing of the vessel, as well as for reduction in the overall weight of the vessel.

Moreover, the invention advantageously makes it possible to obtain an improvement in the stability of the vessel in case of a hull breach, because it provides symmetrical guide for the flow of floodwater towards lower watertight compartments, this resulting in the vessel becoming "heavier", thus promoting the overall stability thereof.

For application to luxury pleasure crafts of the type described above, cavities having a given height and width and separate from the remaining space of the corresponding deck, are provided in the lower deck. Accordingly, transverse bulkheads will have to be provided solely in the underlower deck.

BRIEF DESCRIPTION OF DRAWINGS

Further features and advantages of the invention will become apparent from the following detailed description of a preferred embodiment of the invention, given by way of non-limiting example with reference to the annexed drawings, in which.

DESCRIPTION OF EMBODIMENTS

Below, special reference is made to a luxury pleasure craft, more particularly a yacht.

The invention must not be understood as limited to this type of vessels.

In general, the invention is applicable to pleasure crafts of the type comprising a main deck and a hull, the inner space of which is divided into a plurality of overlying decks.

However, in yachts and other luxury pleasure crafts, optimization of spaces constitutes a critical point at the designing stage because said crafts—even very long yachts—have in any case reduced overall dimensions in comparison with other types of vessels, and because the passengers' comfort is a parameter of fundamental importance.

Figure 1A:
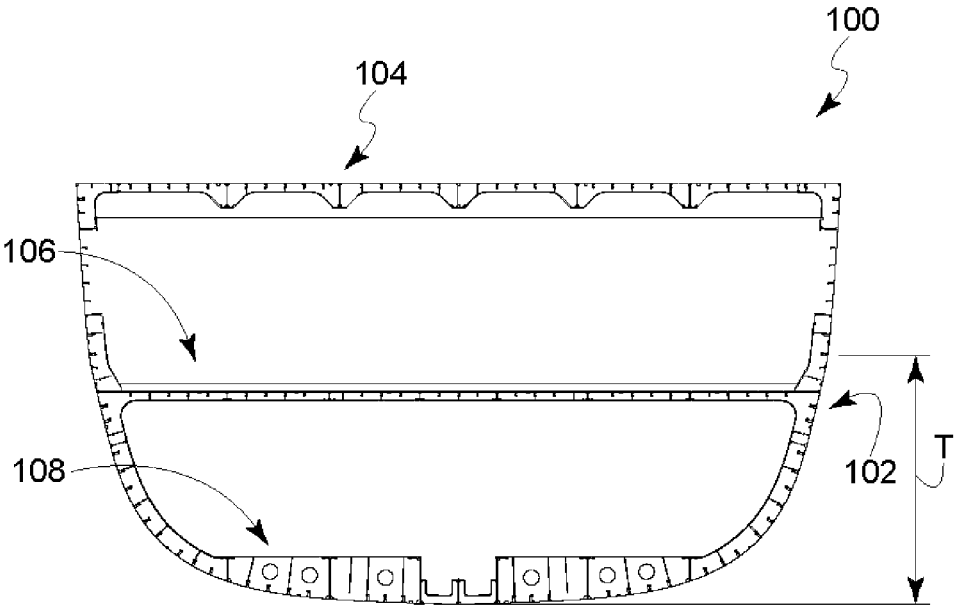
Fig. 1a (PRIOR ART)
FIG. 1*a* is a schematic cross-sectional view of the hull of a pleasure craft according to prior art.
Figure 1B:
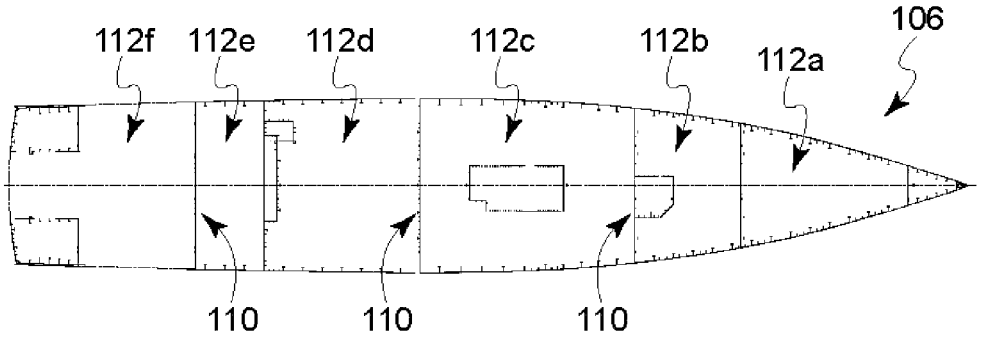
Fig. 1b (PRIOR ART)
FIG. 1*b* is a sectional view taken along the line B-B of the craft of FIG. 1*a;*

Referring at first to FIGS. 1*a* and 1*b*, these schematically illustrate a pleasure craft 100 according to prior art.

Said craft 100 essentially comprises a hull 102 and a main deck 104, on which a superstructure (not shown) for the passengers and the craft owner is provided.

The height T from the bottom of the hull is the draught of the craft.

The inner space of the hull is divided into one or more overlying decks.

In particular, in the craft illustrated in FIGS. 1*a*-1*b*, the inner space of the hull is divided into two overlying decks, namely a lower deck (or middle deck) 106 and an underlower deck (or lowermost deck) 108.

In known vessels, the freeboard deck coincides with the main deck 104.

Accordingly, all the space below the main deck 104 has to be divided into watertight compartments.

This results in the need to provide a plurality of transverse bulkheads distributed over the longitudinal length of the vessel both between the underlower deck 108 and the lower deck 106 and between the lower deck 106 and the main deck 104.

Referring in particular to the lower deck, as can be seen in FIG. 1*b*, this is divided, by means of transverse bulkheads 110, into a plurality of separate compartments 112*a*-112*f*.

The provision of the transverse bulkheads 110 and the division into compartments 112*a*-112*f* poses a very penalizing constraint on the arrangement of spaces and furniture in the lower deck, which constitutes a considerable disadvantage, especially in luxury pleasure crafts.

Figure 2A:
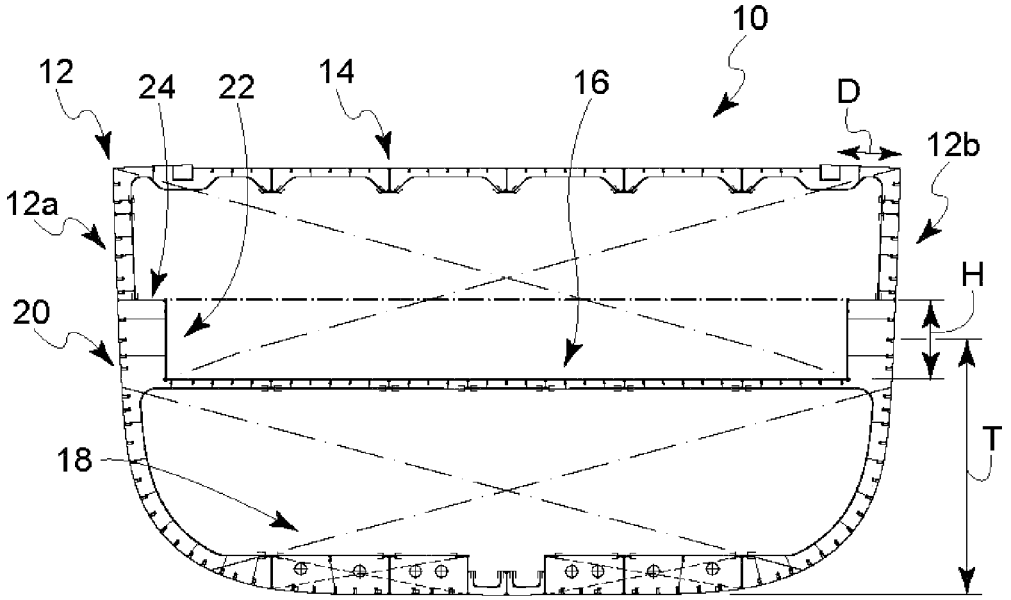
FIG. 2*a* is a schematic cross-sectional view of the hull of a pleasure craft according to the invention.
Figure 2B:
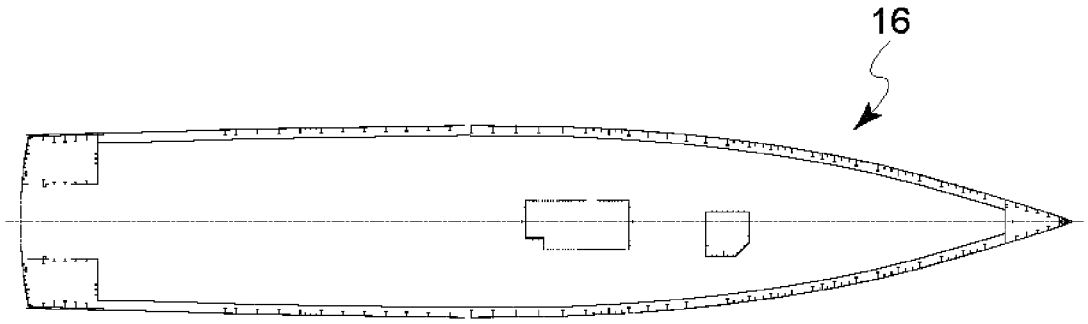
FIG. 2*b* is a sectional view taken along the line B-B of the craft of FIG. 2*a.*

Turning now to FIGS. 2*a*-2*b*, these schematically show a pleasure craft 10 according to the invention.

The craft 10, as well, essentially comprises a hull 12 and a main deck 14, on which a superstructure (not shown) for the passengers and the craft owner is provided.

In this case, as well, the height T from the bottom of the hull 12 is the height of the draught of the craft 10.

In this case, as well, the inner space of the hull is divided into one or more overlying decks, in particular two overlying decks, namely a lower deck (or middle deck) 16, which is above the draught limit T, and an underlower deck (or lowermost deck) 18.

According to the invention, inside the lower deck, along each opposite side of said hull, a lateral cavity 20 is provided, separate from the remaining space of the lower deck 16.

Each cavity 20 is delimited on its outer side by the framing of the side wall of the hull, on its inner side by an additional framing 22, which is provided at a given distance D from the corresponding side wall 12*a*, 12*b* of the hull 12 and extend over a given height H from the floor of the lower deck in a substantially vertical direction, and on its upper side by a connecting framing 24 extending in a substantially horizontal direction between the upper end of the additional framing and the corresponding side wall 12*a*, 12*b* of the hull 12, thus joining at said height H with the framing of the side wall of the hull.

In other words, the inner space of the lower deck 16 is laterally defined by the additional framing 22 up to said given height H and from the side walls 12*a*, 12*b* of the hull above said given height H (unlike what is described in U.S. Pat. No. 865,155, where the inner space of the floating cabin is entirely delimited by its own walls, which are different and separate from the hull walls).

Inferiorly, the bulkheads 20 can be delimited by the floor of the lower deck. Therefore, they are watertight compartments, entirely separate from the inner space of the hull 12.

However, said cavities are preferably open at their bottom and communicating with underlying watertight compartments of the underlower deck. In this case, in case of a hull breach, the floodwater will advantageously be guided towards said lower watertight compartments, thus promoting stability of the craft.

The cavities 20 may possibly be divided along the longitudinal direction into separate compartments by introducing transverse bulkheads.

In case of a breach in a side wall 12*a*, 12*b* of the hull 12, water may flood into the corresponding cavity 20, but it cannot reach the remaining space of the lower deck.

In this way, the provision of the cavities 20 makes it possible to define an imaginary or virtual freeboard deck PBL located at a height H above the floor of the lower deck 16.

The freeboard deck is thus at a dramatically reduced height in comparison with known crafts, in which it coincides with the main deck.

Thanks to the invention, it is possible to eliminate the transverse bulkheads from the lower deck and such transverse bulkheads will have to be provided solely in the underlower deck.

As can be seen in FIG. 2*b*, the lower deck 16 of the pleasure craft 10 is no longer divided along the longitudinal direction into separate compartments.

In particular, the craft shown in FIGS. 2*a*-2*b* implements the teachings of Italian patent No. 102020000007294, which provides for housing all the machinery of the engine room, as well as those of the technical room associated therewith, in the underlower deck (i.e. without the engine room and/or the technical room protruding into the lower deck).

Accordingly, the lower deck 16 can be made as a single space entirely free from any hindrances.

This advantageously allows for large margins of freedom in arranging the spaces and furniture, and provides an aesthetically more appealing environment in comparison with the crafts of known type (see FIG. 1*b*).

The width D and the height H of the lateral cavities 20 are chosen each time according to the specific requirements of each vessel.

In any case, said cavities 20 will have a height H less than the overall height of the lower deck, and a width D less than half of the overall width of the lower deck.

For example, said height H may be between 10% and 70% of the overall height of the lower deck, and preferably between 20% and 50% of the overall height of the lower deck; and said width D may be between 1% and 10% of the overall width of the lower deck, and preferably between 2% and 5% of the overall width of the lower deck.

As a result, the total volume subtracted from the lower deck 16 by the cavities 20 will be limited.

In addition, the surfaces of said cavities 20 may be easily integrated into the furniture of the lower deck and therefore exploited by the passengers.

It will be apparent from the above description that the pleasure craft according to the invention makes it possible to achieve the objects set forth above, remarkably improving usability of the lower deck.

It will also be apparent to the person skilled in the art that the above detailed description has been given by way of non-limiting example and that several modifications and variants are possible without departing from the scope of the present invention as defined by the appended claims.

In particular, the invention is not limited to pleasure crafts comprising only two overlying decks inside the hull, but it can also be applied to pleasure crafts with any number of overlying decks inside the hull.

In this case, separate cavities according to the improved deck constructions of the invention may be provided in one or more decks.

In particular, such cavities will preferably be provided at least in the deck immediately above the draught of the craft or in one or more decks above the draught of the craft.

The invention claimed is:

1. A pleasure craft, comprising:

a main deck and a hull, the hull having two opposite sides and two opposite side walls and an inner space between the opposite side walls, wherein the opposite side walls of the hull are made of framing, wherein the inner space of the hull is divided into a plurality of overlying decks, each overlying deck having a floor and an overall height from the floor and an overall width between the two opposite sides of the hull, wherein the plurality of overlying decks include at least a lower deck located below the main deck and an underlying underlower deck located below the lower deck and immediately above a keel of the hull, wherein, on the lower deck inside the hull, along each of the opposite sides of the hull, a lateral cavity is provided, which is separate from a remaining space of the corresponding lower deck, wherein each lateral cavity has an outer side, an inner side, a lower side, and an upper side, wherein each lateral cavity is delimited on its the outer side of the lateral cavity by a corresponding side wall of the hull and each lateral cavity is integral at the outer side with the corresponding opposite side wall of the hull and at the lower side of the lateral cavity with the floor of the lower deck, wherein each lateral cavity extends vertically from the floor of the lower deck over a given vertical extension and at a given distance from the corresponding side wall of the hull, wherein the given distance is less than half of the overall width of the lower deck, and the given vertical extension is less than the overall height of the lower deck, wherein each lateral cavity is delimited on the outer side of the lateral cavity by the framing of the corresponding side wall of the hull, wherein each lateral cavity is delimited on the inner side of the lateral cavity by an additional framing, which is provided at the given distance from the corresponding side wall of the hull and extends from the floor of the lower deck in a substantially vertical direction over the given vertical extension, and wherein each lateral cavity is delimited on the upper side of the lateral cavity by a connecting framing which extends in a substantially horizontal direction between an upper end of the additional framing and the corresponding side wall of the hull, thus joining with the framing of the side wall of the hull, and wherein each lateral cavity is communicating at the lower side of the lateral cavity with one or more underlying watertight compartments provided between the lower deck and the underlying underlower deck.

2. The pleasure craft according to claim 1, wherein the hull has a longitudinal axis and each lateral cavity has a longitudinal direction parallel to the longitudinal axis of the hull, and wherein each lateral cavity is divided along the longitudinal direction into separate compartments by means of transverse bulkheads.

3. The pleasure craft according to claim 1, wherein a height of the given vertical extension is between 10% and 70% of the overall height of the lower deck.

4. The pleasure craft according to claim 3, wherein the height of the given vertical extension is between 20% and 50% of the overall height of the lower deck.

5. The pleasure craft according to claim 1, wherein each lateral cavity has a width between 1% and 10% of the overall width of the lower deck.

6. The pleasure craft according to claim 5, wherein the width of each lateral cavity is between 2% and 5% of the overall width of the lower deck.

7. The pleasure craft according to claim 1, wherein the lower deck is made without transverse bulkheads.

8. The pleasure craft according to claim 1, wherein the pleasure craft is a yacht.

9. A pleasure craft, comprising:

a main deck and a hull, the hull having two opposite sides and two opposite side walls and an inner space between the opposite side walls, wherein the opposite side walls of the hull are made of framing, wherein the inner space of the hull is divided into a plurality of overlying decks, each overlying deck having a floor and an overall height from the floor and an overall width between the two opposite sides of the hull, wherein the plurality of overlying decks include at least a lower deck located below the main deck and an underlying underlower deck located below the lower deck and immediately above a keel of the hull, wherein, on the lower deck inside the hull, along each of the opposite sides of the hull, a lateral cavity is provided, which is separate from a remaining space of the corresponding lower deck, wherein each lateral cavity has an outer side, an inner side, a lower side, and an upper side, wherein each lateral cavity is delimited on the outer side of the lateral cavity by a corresponding side wall of the hull and each lateral cavity is integral at the outer side with the corresponding opposite side wall of the hull and at the lower side of the lateral cavity with the floor of the lower deck, wherein each lateral cavity extends vertically from the floor of the lower deck over a given vertical extension and at a given distance from the corresponding side wall of the hull, wherein the given distance is less than half of the overall width of the lower deck, and the given vertical extension is less than the overall height of the lower deck, wherein each lateral cavity is delimited on the outer side of the lateral cavity by the framing of the corresponding side wall of the hull, wherein each lateral cavity is delimited on the inner side of the lateral cavity by an additional framing, which is provided at the given distance from the corresponding side wall of the hull and extends from the floor of the lower deck in a substantially vertical direction over the given vertical extension, and wherein each lateral cavity is delimited on the upper side of the lateral cavity by a connecting framing which extends in a substantially horizontal direction between an upper end of the additional framing and the corresponding side wall of the hull, thus joining with the framing of the side wall of the hull, and wherein each lateral cavity is watertight.

10. The pleasure craft according to claim 9, wherein the hull has a longitudinal axis and each lateral cavity has a longitudinal direction parallel to the longitudinal axis of the hull, and wherein each lateral cavity is divided along the longitudinal direction into separate compartments by means of transverse bulkheads.

11. The pleasure craft according to claim 9, wherein a height of the given vertical extension is between 10% and 70% of the overall height of the lower deck.

12. The pleasure craft according to claim 11, wherein the height of the given vertical extension is between 20% and 50% of the overall height of the lower deck.

13. The pleasure craft according to claim 9, wherein each lateral cavity has a width between 1% and 10% of the overall width of the lower deck.

14. The pleasure craft according to claim 13, wherein the width of each lateral cavity is between 2% and 5% of the overall width of the lower deck.

15. The pleasure craft according to claim 9, wherein the lower deck is made without transverse bulkheads.

16. The pleasure craft according to claim 9, wherein the pleasure craft is a yacht.

* * * * *